US009297263B2

(12) United States Patent
Tarczy et al.

(10) Patent No.: US 9,297,263 B2
(45) Date of Patent: Mar. 29, 2016

(54) TURBINE BLADE FOR A GAS TURBINE ENGINE

(71) Applicant: Solar Turbines Incorporated, San Diego, CA (US)

(72) Inventors: Jeffrey Eugene Tarczy, San Diego, CA (US); Leslie John Faulder, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 856 days.

(21) Appl. No.: 13/665,536

(22) Filed: Oct. 31, 2012

(65) Prior Publication Data

US 2014/0119917 A1 May 1, 2014

(51) Int. Cl.

| | |
|---|---|
| ***F01D 5/22*** | (2006.01) |
| ***F01D 11/00*** | (2006.01) |
| ***F01D 5/30*** | (2006.01) |

(52) U.S. Cl.

CPC ..... *F01D 5/22* (2013.01); *F01D 5/3015* (2013.01); *F01D 5/3069* (2013.01); *F01D 11/006* (2013.01)

(58) Field of Classification Search

CPC ..... F01D 5/22; F01D 5/225; F01D 5/24; F01D 5/26; F01D 5/3007; F01D 5/3015; F01D 5/3069; F01D 11/006; F01D 11/008

See application file for complete search history.

(56) References Cited

U.S. PATENT DOCUMENTS

| | | | | |
|---|---|---|---|---|
| 3,610,778 | A * | 10/1971 | Suter | 416/210 R |
| 3,751,183 | A * | 8/1973 | Nichols et al. | 416/220 R |
| 4,175,912 | A | 11/1979 | Crane et al. | |
| 4,473,337 | A | 9/1984 | Leonardi et al. | |
| 4,558,988 | A | 12/1985 | Kisling et al. | |
| 5,030,063 | A | 7/1991 | Berger | |
| 5,478,207 | A * | 12/1995 | Stec | 416/219 R |
| 5,599,170 | A | 2/1997 | Marchi et al. | |
| 5,746,578 | A | 5/1998 | Brassfield et al. | |
| 6,331,097 | B1 * | 12/2001 | Jendrix | 416/96 R |
| 6,520,743 | B2 * | 2/2003 | Arilla et al. | 416/220 R |
| 6,682,307 | B1 * | 1/2004 | Tiemann | 416/193 A |
| 6,786,696 | B2 * | 9/2004 | Herman et al. | 416/96 R |
| 7,371,050 | B2 | 5/2008 | Pasquiet | |
| 7,507,075 | B2 * | 3/2009 | Kang et al. | 416/248 |
| 7,566,201 | B2 | 7/2009 | Brillert et al. | |
| 8,011,892 | B2 | 9/2011 | Ramlogan et al. | |
| 8,096,776 | B2 | 1/2012 | Bluck et al. | |
| 8,573,942 | B2 * | 11/2013 | Strohl et al. | 416/219 R |
| 2009/0116953 | A1 | 5/2009 | Spangler et al. | |
| 2010/0158686 | A1 * | 6/2010 | Kim et al. | 416/1 |
| 2010/0254807 | A1 | 10/2010 | Smoke et al. | |
| 2011/0243749 | A1 * | 10/2011 | Praisner et al. | 416/223 A |
| 2012/0121434 | A1 | 5/2012 | Kim et al. | |

(Continued)

FOREIGN PATENT DOCUMENTS

| | | | |
|---|---|---|---|
| GB | 2412699 | A | 10/2005 |

*Primary Examiner* — Edward Look

*Assistant Examiner* — Christopher R Legendre

(74) *Attorney, Agent, or Firm* — Finnegan, Henderson, Farabow, Garrett & Dunner, LLP

(57) ABSTRACT

A turbine blade for a gas turbine engine may include a platform, an airfoil extending above the platform, and a root structure extending below the platform. The root structure may extend from a forward face to an aft face and include a shank region proximate the platform and a lower portion distal to the platform. The forward face of the shank region may project outward from the forward face of the lower portion.

13 Claims, 10 Drawing Sheets

(56) References Cited

U.S. PATENT DOCUMENTS

2013/0323031 A1* 12/2013 Zhang et al. ..... 415/173.1
2013/0323058 A1* 12/2013 Zhang et al. ..... 416/144
2014/0119916 A1* 5/2014 Faulder et al. ..... 416/95
2014/0119917 A1* 5/2014 Tarczy et al. ..... 416/140
2014/0119918 A1* 5/2014 Tarczy et al. ..... 416/144
2014/0119943 A1* 5/2014 Tarczy et al. ..... 416/96 R

* cited by examiner

TURBINE BLADE FOR A GAS TURBINE ENGINE

TECHNICAL FIELD

The present disclosure relates generally to a turbine blade for a gas turbine engine, and more particularly, to a turbine blade for a turbine rotor assembly having features to regulate the flow of cooling air therethrough.

BACKGROUND

A gas turbine engine ("GTE") includes a turbine assembly that extracts energy from a flow of hot combustion gases. Turbine assemblies include one or more turbine rotor assemblies mounted on a drive shaft. Each turbine rotor assembly includes a plurality of turbine blades extending radially outward from a rim of a rotor (or disk) of the turbine rotor assembly. The hot combustion gases flowing through the turbine assembly push on the blades to rotate the rotor, and consequently the drive shaft. The rotating drive shaft is used to power a load, for example, a generator, a compressor, or a pump.

A turbine blade (blade) typically includes a root structure and an airfoil extending from opposite sides of a blade platform. The root structure of each blade is inserted into a similarly-shaped slot in the rotor to secure the blade to the rotor. A cooling air supply is directed through the turbine rotor assembly to cool the assembly during operation of a GTE. The turbine rotor assembly may include components, such as retainers, to retain the blade to the rotor and to direct the flow of cooling air through desired areas of the assembly. One example of such a component is described in U.S. Pat. No. 6,331,097 B1 Jendrix ("the '097 patent"). The '097 patent discloses forward and aft retainers that are attached to the turbine rotor to prevent the blades from moving in an axial direction and to channel the flow of cooling air through desired regions of the turbine rotor.

SUMMARY

The present disclosure provides a turbine blade for a gas turbine engine. The turbine blade may include a platform, an airfoil extending above the platform, and a root structure extending below the platform. The root structure may extend from a forward face to an aft face and include a shank region proximate the platform and a lower portion distal to the platform. The forward face of the shank region may project outward from the forward face of the lower portion.

The present disclosure also provides a turbine rotor assembly of a gas turbine engine. The turbine rotor assembly may include a plurality of turbine blade slots extending radially inward from an outer rim. Each turbine blade slot may extend radially from an inner end to the outer rim and extend axially from a forward end to an aft end of the rotor. The turbine rotor assembly may also include a plurality of turbine blades having an airfoil and a root structure extending from opposite sides of a platform. The root structure of each turbine blade may include a portion shaped to be received in a corresponding turbine blade slot of the rotor. The turbine rotor assembly may also include a damper positioned between the root structures of two adjacent turbine blades of the plurality of turbine blades. The damper may extend axially from the forward end to the aft end of the rotor, and include a forward plate at the forward end and an aft plate at the aft end. A front face of the forward plate may form a flush surface with front surfaces of the root structures of the two adjacent turbine blades.

The present disclosure further provides a turbine rotor assembly of a gas turbine engine. The turbine rotor assembly may include a turbine rotor extending from a forward end to an aft end. The turbine rotor may include a plurality of turbine blade slots extending radially inwards from an outer rim, and a groove positioned at the aft end. The turbine rotor assembly may also include a plurality of turbine blades having a root structure extending below a platform. A portion of the root structure of each turbine blade may be positioned in a corresponding turbine blade slot of the rotor. The turbine rotor assembly may also include a damper positioned between the root structures of two adjacent turbine blades of the plurality of turbine blades. The damper may include a forward plate at the forward end of the rotor and an aft plate at the aft end of the rotor. The damper may also include a nub that extends in an aft direction from a lower portion of the aft plate. The nub may be positioned in the groove of the turbine rotor.

DETAILED DESCRIPTION

Figure 1:
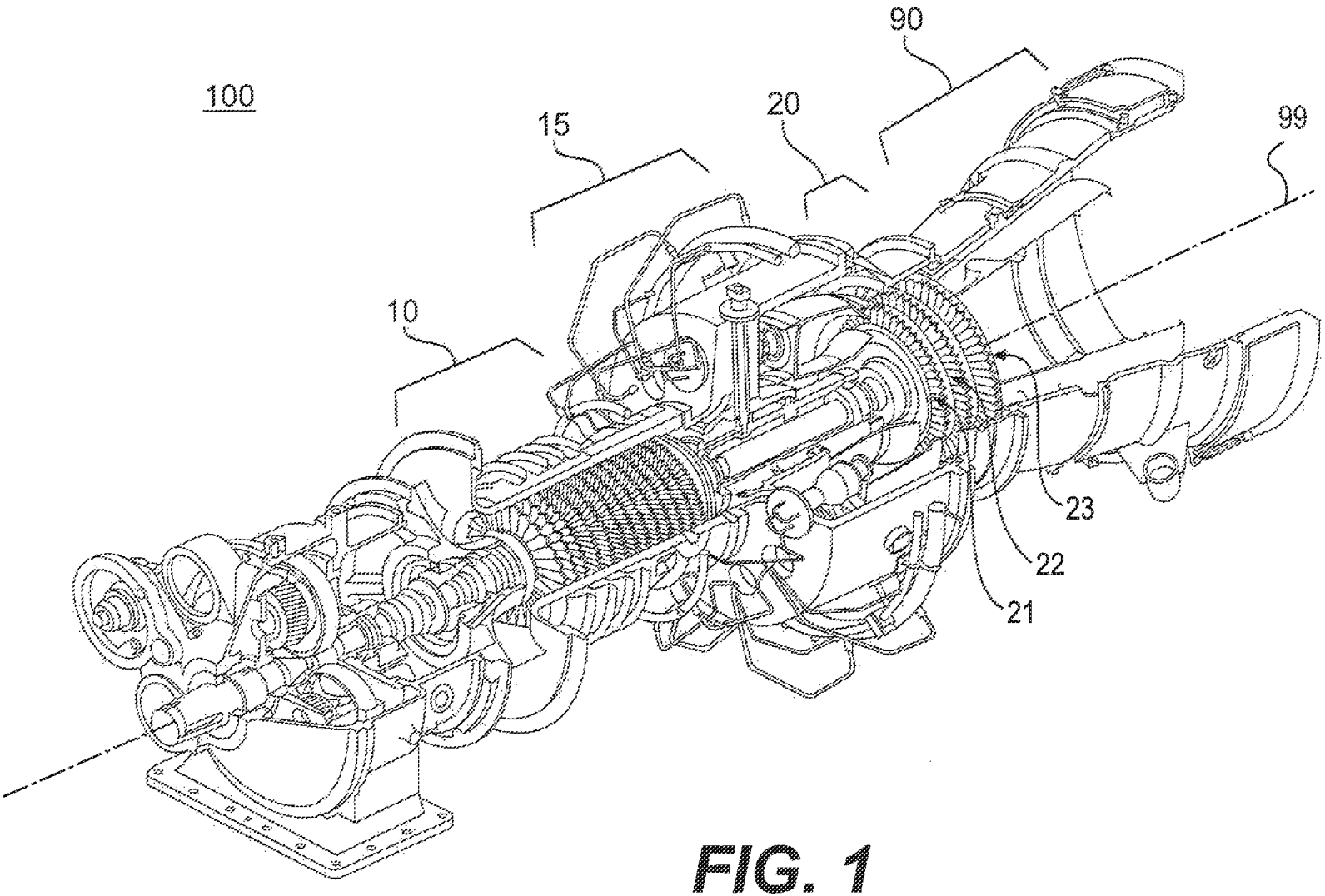
FIG. 1 is an illustration of an exemplary gas turbine engine.

FIG. 1 illustrates an exemplary gas turbine engine (GTE) 100. GTE 100 may have, among other systems, a compressor system 10, a combustor system 15, a turbine system 20, and an exhaust system 90 arranged along an engine axis 99. Compressor system 10 compresses air and delivers the compressed air to the combustor system 15. A fuel (liquid or gaseous) is mixed with the compressed air and combusted in the combustor system 15 to produce combustion gases at high pressure and temperature. These combustion gases are used in the turbine system 20 to produce mechanical power. After passing through turbine system 20, the spent combustion gases may be expelled into the atmosphere through one or more air cleaning devices.

The turbine system 20 may include a plurality of turbine rotor assemblies or turbine stages axially aligned along the engine axis 99. Although only three turbine rotor assemblies 21, 22, 23 are illustrated in FIG. 1, other embodiments of turbine system 20 may include a different number of stages. Each turbine rotor assembly may be mounted on a common drive shaft (not shown) that extends along engine axis 99, and may include a plurality of turbine blades extending radially outwards from a disk or a turbine rotor of the assembly. During operation, as the combustion gases from combustor system 15 pass through the turbine system 20, they rotate the turbine blades and the drive shaft.

Figure 2:
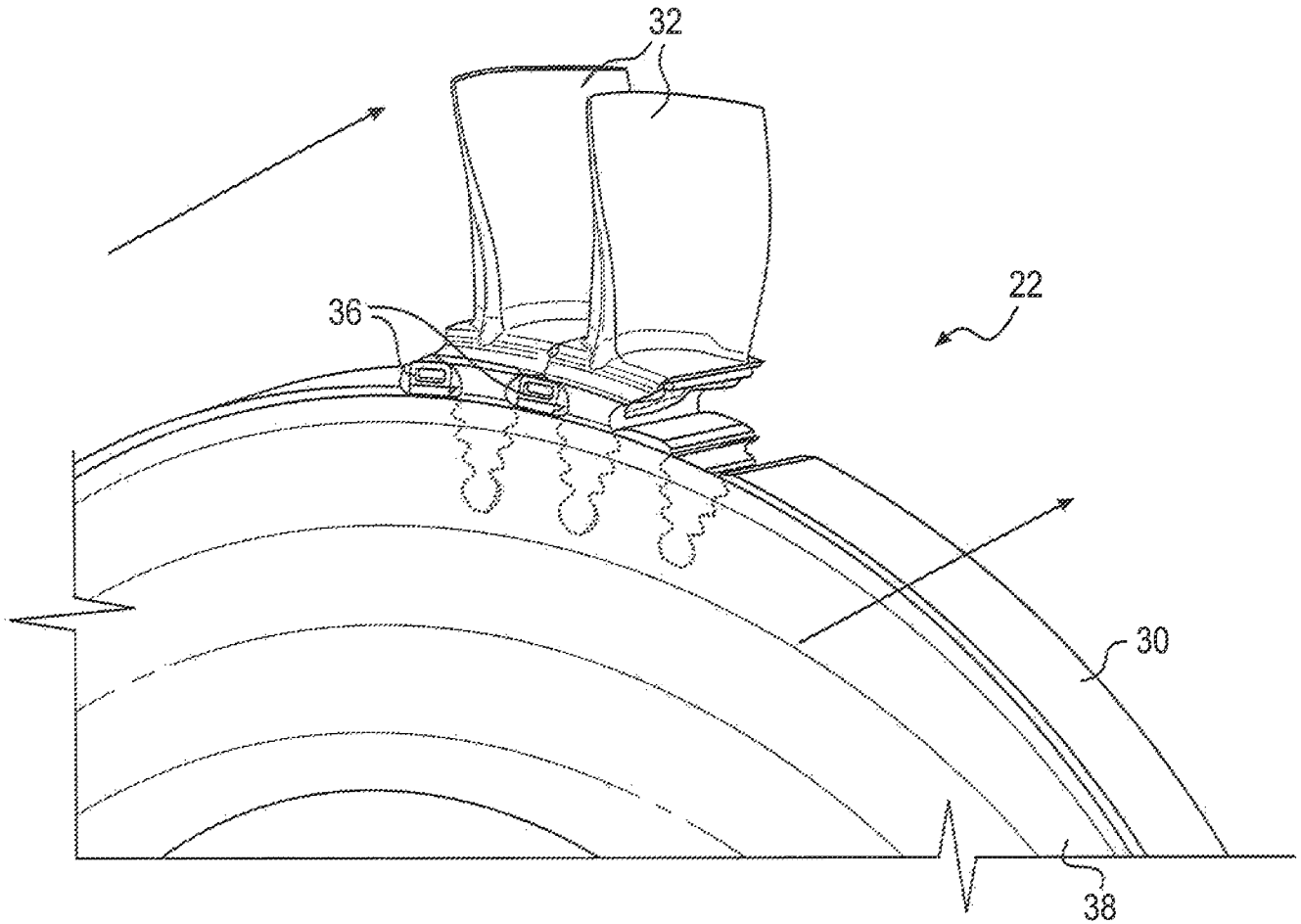
FIG. 2 is an illustration of a portion of an exemplary turbine rotor assembly.

Referring to FIG. 2, turbine rotor assembly 22 includes, among other components, a turbine disk or rotor 30, a plurality of turbine blades 32, a plurality of turbine dampers 36 positioned between the turbine blades 32, and a seal plate 38 attached to the forward face of the rotor 30. For the purposes of this description, reference to term "forward" refers to upstream locations in the flow of combustion gases through the turbine system, and "aft" refers to downstream locations (see arrow indicating the direction of the flow of combustion gases in FIG. 2). Also, "inner" and "outer" refers to radially inner and radially outer positions with respect to engine axis 99. A plurality of turbine rotor assemblies may be axially aligned on the drive shaft to form a plurality of turbine stages of the GTE 100. FIG. 2 illustrates the relative positions of turbine blades 32, damper 36, and seal plate 38 on the turbine rotor 30 at an angled view from a generally forward to aft direction. Although turbine rotor assembly 22 is illustrated in FIG. 2 with two turbine blades 32 and two dampers 36, it is understood that each turbine rotor assembly 22 may include a plurality of turbine blades 32 positioned circumferentially around turbine rotor 30 with a damper 36 positioned between each two adjacent turbine blades 32.

Figure 4:
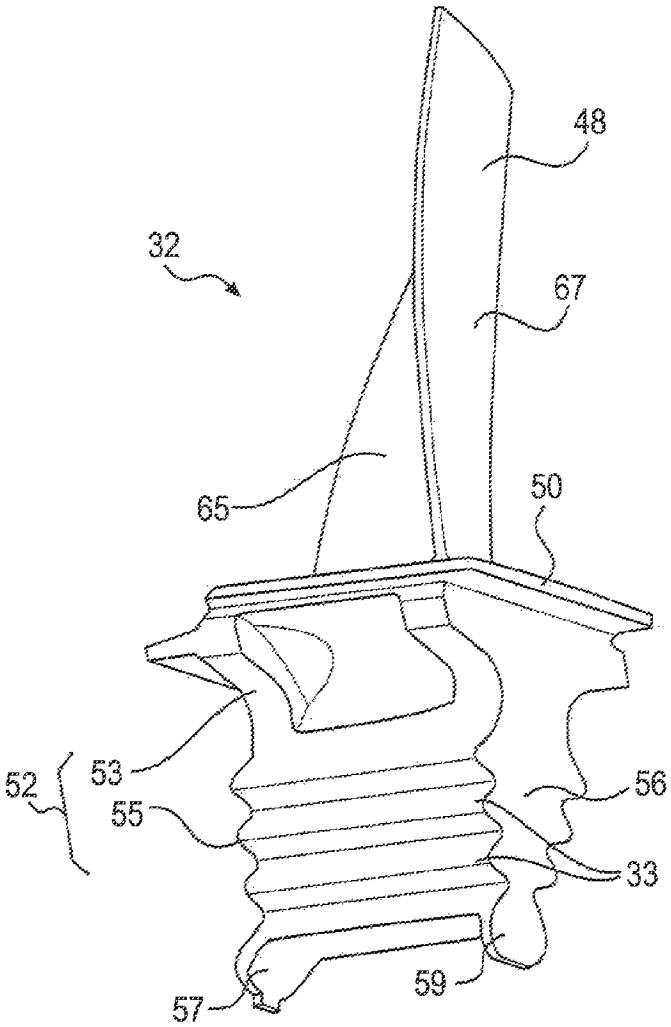
FIG. 4 is an illustration of an exemplary turbine blade viewed from an aft end of the turbine rotor assembly.
Figure 3:
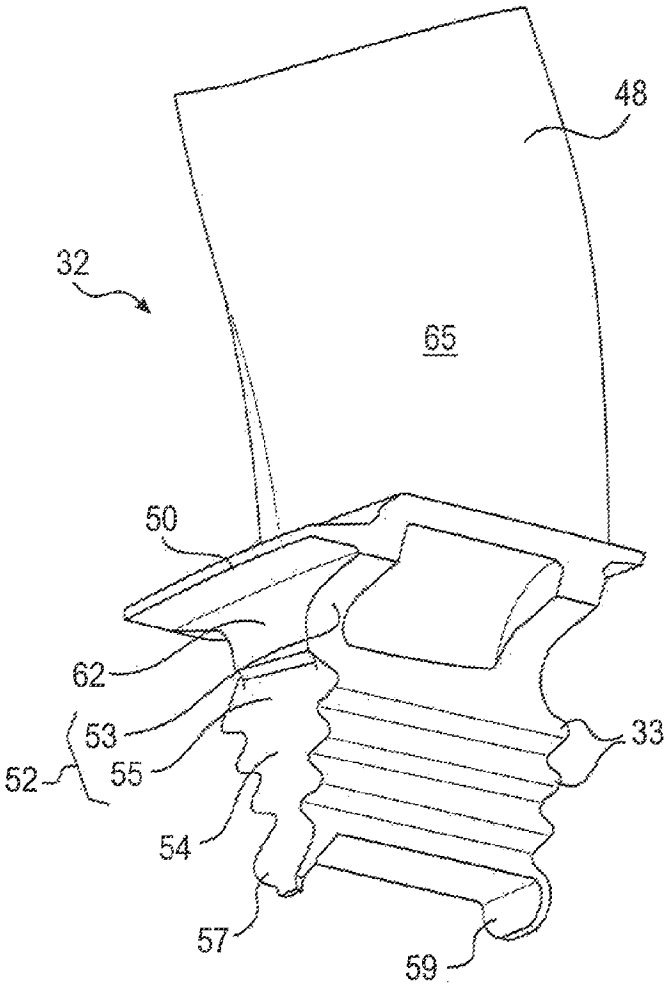
FIG. 3 is an illustration of an exemplary turbine blade viewed from a forward end of the turbine rotor assembly.

FIGS. 3 and 4 illustrate forward and aft views, respectively, of an exemplary turbine blade 32. In the discussion below, reference will be made to FIGS. 3 and 4. Turbine blade 32 includes an airfoil 48 extending upwards from one side of a blade platform 50 and a root structure 52 extending downwards from the opposite side of the platform 50. Airfoil 48 has a concave surface 65 on one side and a convex surface 67 on the opposite side. The root structure 52 of turbine blade 32 extends from a forward face 54 to an aft face 56. Forward face 54 and concave airfoil surface 65 may generally face the forward (or the upstream) direction of the turbine rotor assembly 22, and the aft face 56 and convex airfoil surface 67 may generally face the aft (or the downstream) direction of the turbine rotor assembly 22.

Root structure 52 includes a shank 53 and a lower portion 55. Lower portion 55 of root structure 52 may have a fir-tree type shape with a series of lobes 33 spaced apart from each other in the radial direction. The bottom-most end of lower portion 55 includes a forward tab 57 and an aft tab 59 that extend radially inward. Shank 53 is located radially outward the lower portion 55. A front surface 62 of the shank 53 may project forward from a front surface of the lower portion 55 to form a stepped surface. That is, the forward face 54 of the root structure 52 may be a stepped surface with a step separating the front surface 62 of the shank 53 from the front surface of the lower portion 55. In some embodiments, the front surface 62 may project forward from the front surface of the lower portion 55 by between about 0.03-0.06 inches (0.76-1.52 mm).

Figure 5:
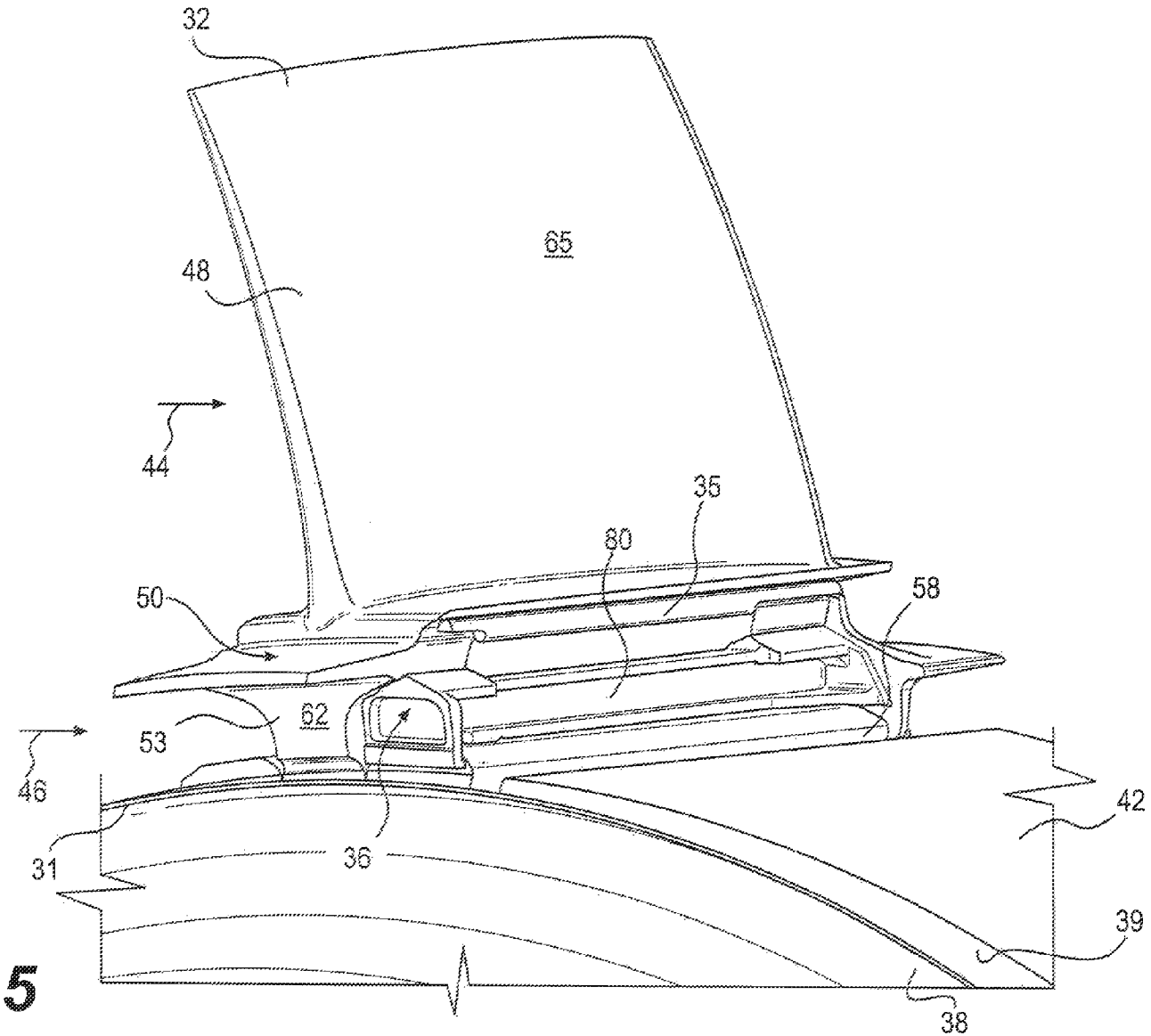
FIG. 5 is an illustration of a portion of the turbine rotor assembly of FIG. 2 with an exemplary damper and seal plate.
Figure 6:
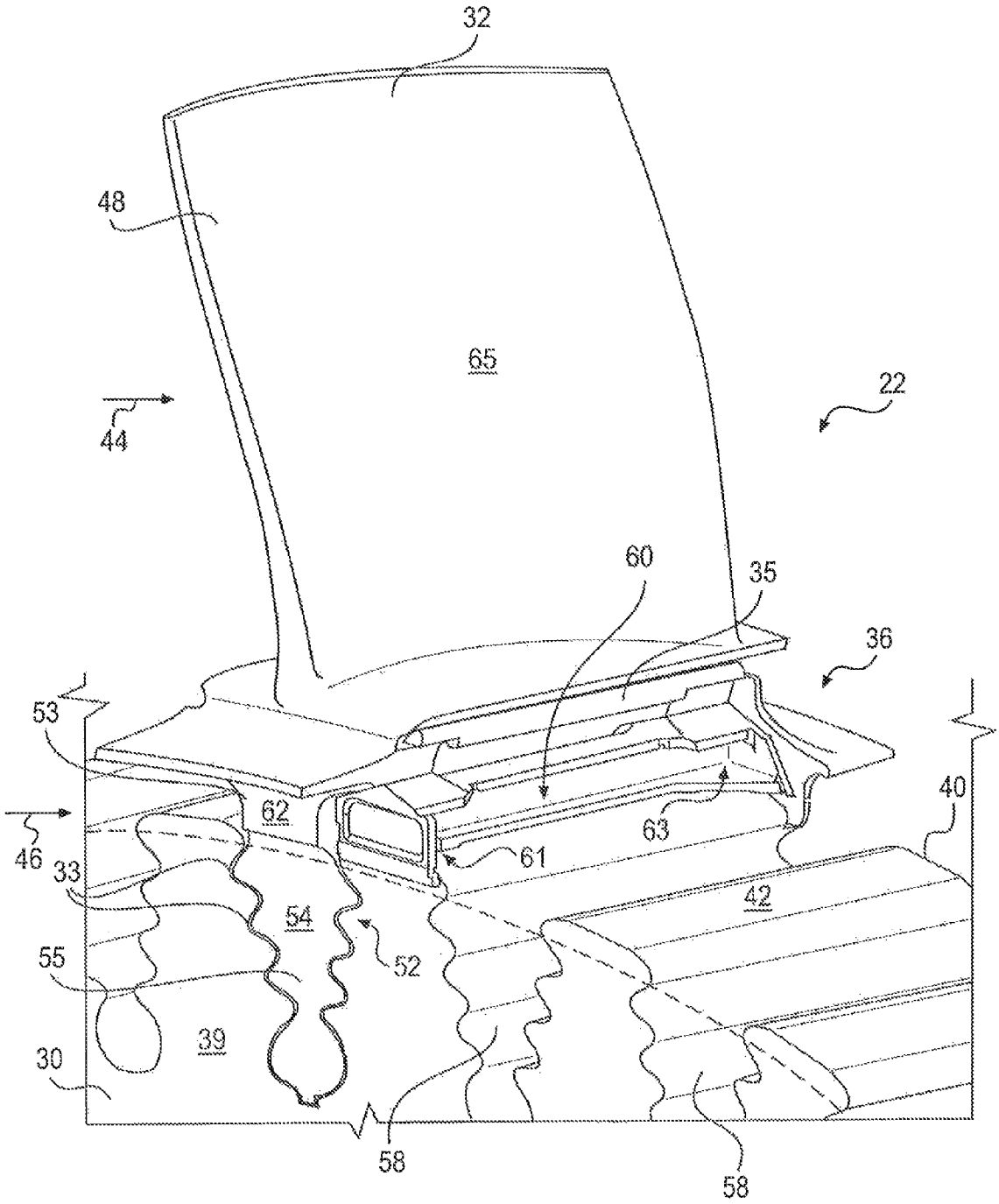
FIG. 6 is an illustration of a portion of the turbine rotor assembly of FIG. 2 with the seal plate removed.

FIGS. 5 and 6 illustrate the turbine blade 32 attached to rotor 30 with a damper 36 positioned beside the turbine blade 32. FIG. 5 illustrates a view with the seal plate 38 attached, and FIG. 6 illustrates a view with the seal plate 38 removed (with its outline illustrated in dashed lines) to show the features covered by the seal plate 38. Turbine rotor 30 includes a forward face 39, an aft face 40, and a circumferential outer edge 42. Slots 58 extend axially from the forward face 39 to the aft face 40 of rotor 30. These slots 58 may be shaped similar to the lower portion 55 of the blade root structure 52. That is, in embodiments of turbine blades 32 with a fir-tree shaped lower portion 55, the slots 58 may also have a fir-tree shape, and these slots 58 may be dimensioned to fit the lower portion 55 (of the blade root structure 52) therein. The lower portion 55 of the multiple turbine blades 32 is inserted into a corresponding slot 58 from the forward face 39 of the rotor 30 to assemble the blades 32 to the rotor 30. During assembly of the blades 32, the forward tab 57 of the blades 32 engage with the forward face 39 of rotor 30 to prevent further movement of the blades 32 in the aft direction.

Figure 13:
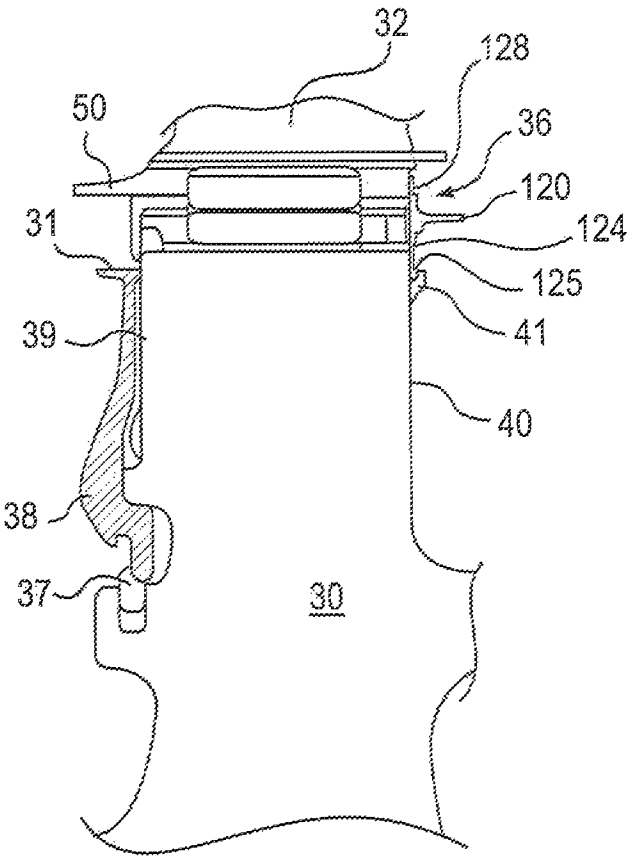
FIG. 13 is a cross-sectional view of a portion of an exemplary turbine rotor assembly.
Figure 12:
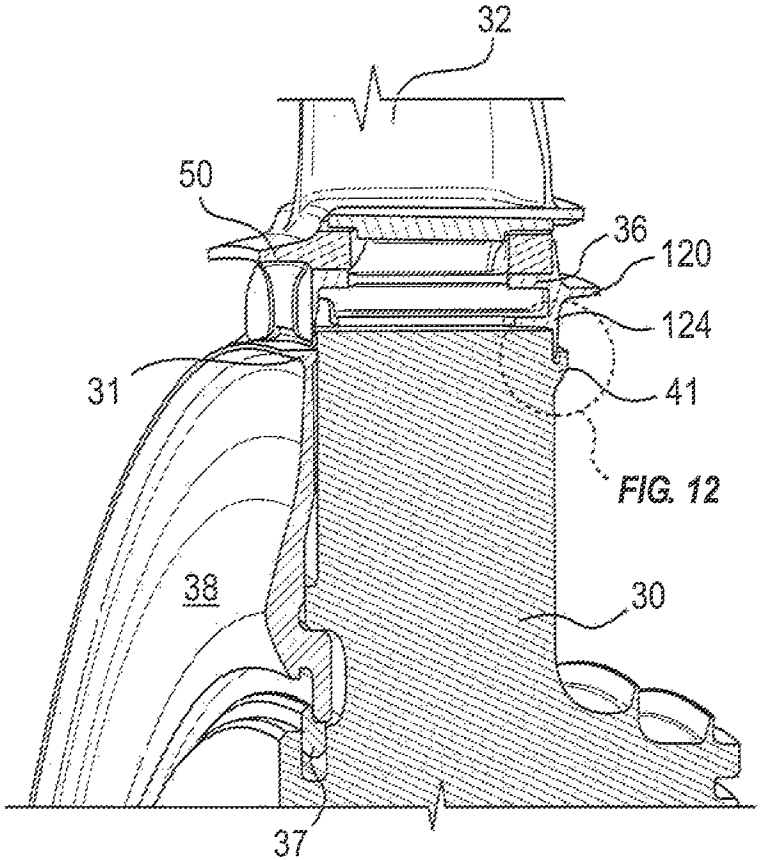
FIG. 12 is a three-dimensional sectional view of a portion of an exemplary turbine rotor assembly.

After the multiple turbine blades 32 are inserted into the respective slots 58 of the rotor 30, seal plate 38 is secured to the forward face 39 of the rotor 30 using a snap ring 37 (FIG. 12) to substantially cover the slots 58 at the forward face 39 of the rotor 30 (seal plate 38 and its attachment to rotor 30 may be best seen in FIGS. 12 and 13). When the seal plate 38 is attached to the rotor 30, the forwardly-projecting front surface 62 of the shank 53 of each blade root structure 52 may be positioned radially outward the seal plate 38, and may be exposed. The term substantially is used in this context because, in some embodiments (see FIG. 5), a small portion (≤0.15 inches (3.81 mm)) of the slot 58 at the outer portion of the rotor 30 may not be covered by the seal plate 38. The seal plate 38 is an annular ring-shaped component having an inner diameter and an outer diameter. The seal plate 38 is secured to the forward face 39 of the rotor 30 at its inner diameter using the snap ring 37 (FIG. 12). As seen more clearly in FIG. 12, at its outer diameter the seal plate 38 includes a circumferential lip 31 that extends in both the forward and the aft direction. When the seal plate 38 is installed on the rotor 30 using snap ring 37, the circumferential lip 31 at the outer diameter of the seal plate 38 contacts, and presses against, the forward faces 39, 54 of the blade root structure 52 and the rotor 30 to lock the blade 32 in the rotor 30. The circumferential lip 31 contacts the forward faces 39, 54 above the top-most lobe 33 of the fir-tree shaped blade root structure 52 (see FIG. 6). In this configuration, the seal plate 38 covers the gaps formed at the interface of the root structure 52 and the slot 58 (of rotor 30), and thus prevents or reduces the entry of cooling air into these gaps.

With reference to FIG. 6, when turbine blades 32 are mounted in adjacent slots 58 of the rotor 30, an under-platform cavity 60 is formed between shanks 53 of adjacent root structures 52, below the platforms 50 of adjacent blades 32, and above circumferential outer edge 42 of the rotor 30. Under-platform cavity 60 may include a forward end 61 adjacent forward face 39 of rotor 30, and an aft end 63 adjacent aft face 40 of turbine rotor 30. A damper 36 may be located in the under-platform cavity 60 between the turbine rotor 30 and two adjacent turbine blades 32. When the turbine rotor assembly 22 rotates at a high speed during operation of GTE 100, centrifugal forces push the damper 36 radially outward against the underside of platforms 50 to eliminate or reduce vibrations.

Figure 7:
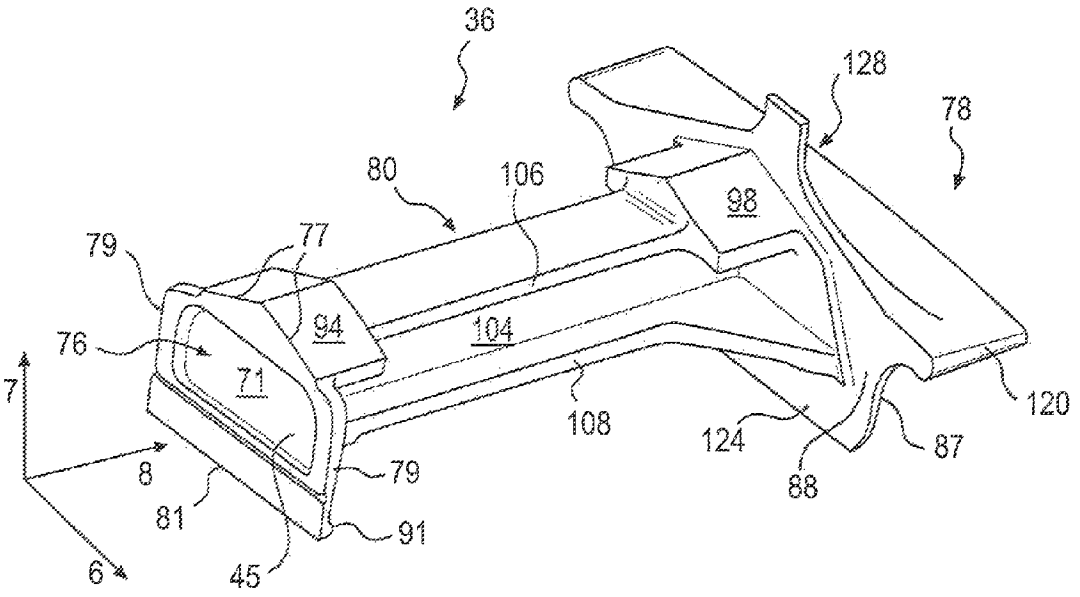
FIG. 7 is an illustration of the damper of FIG. 5 viewed from a forward end of the turbine rotor assembly.
Figure 8:
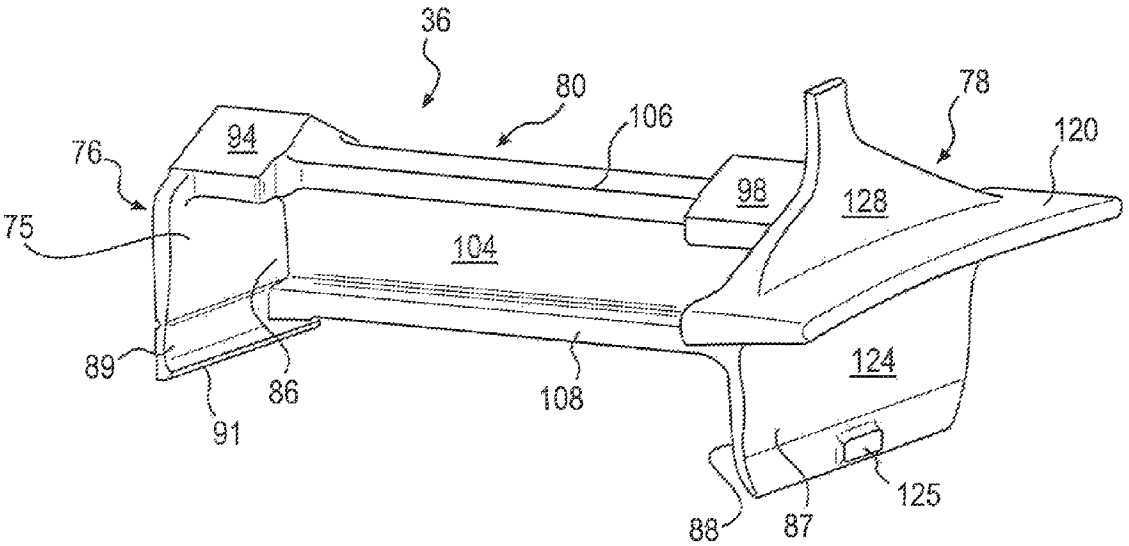
FIG. 8 is an illustration of the damper of FIG. 5 viewed from an aft end of the turbine rotor assembly.
Figure 9:
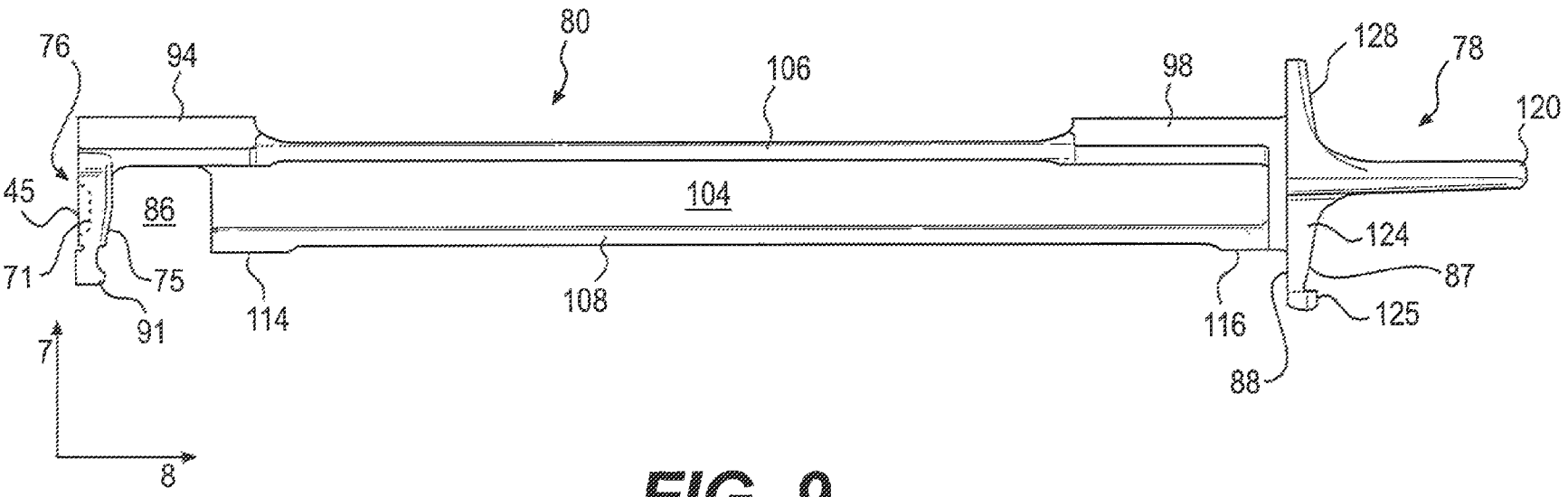
FIG. 9 is an illustration of the side view of the damper of FIG. 5.

FIGS. 7, 8, and 9 illustrate forward, aft, and side views, respectively, of a damper 36 having a width dimension 6, a height dimension 7, and a length dimension 8. Damper 36 includes a forward plate 76 having a forward face 45 and aft face 75, and an aft plate 78 including a forward face 88 and an aft face 87. The aft face 75 of the forward plate 76 is connected to the forward face 88 of the aft plate 78 by a longitudinal structure 80. Forward plate 76 may have a profile that includes a substantially rectangular lower portion and a substantially triangular upper portion. The term substantially is used in this context to indicate that the corners or edges of the lower and upper portions may, in some embodiments, be rounded. The profile of the forward plate 76 may define an area that is larger than the cross-sectional area of longitudinal structure 80, but is smaller than the area occupied by aft plate 78. The overall width and height of forward plate 76 may be smaller than the overall width and height of aft plate 78. The substantially triangular upper portion of the forward plate 76 may be defined by tapered upper walls 77, and the substantially rectangular lower portion of the forward plate 76 may be defined by generally straight side and bottom walls 79, 81. The tapered upper walls 77 may extend in the aft direction to form a forward seating surface 94 on the forward plate 76. The sloping sides of the forward seating surface 94 may converge on a line that is inclined at an angle between about −10° to +10° from the forward plate 76. The forward seating surface 94 may have a wedge-like configuration to mate with the underside geometry of platform 50 of turbine blade 32.

The forward face 45 of forward plate 76 (FIG. 7) may include a generally flat surface with a depression or a pocket 71 formed thereon. In some embodiments, the pocket 71 may have a shape generally similar to, or conforming to, the outer profile of the forward plate 76. In some embodiments, the pocket 71 may have a substantially quadrilateral (square or rectangular) shape. In general, the depth of pocket 71 may be between about 25-50% of the thickness of forward plate 76. In some embodiments, the thickness of forward plate 76 may be between about 0.04-0.06 inches (1.02-1.52 mm), and the depth of pocket 71 may be between about 0.015-0.025 inches (0.38-0.64 mm). In some embodiments, the area of the pocket 71 may be greater than half the area of the forward plate 76. In some embodiments, the width and height of pocket 71 may be greater than half the width and height, respectively, of the forward plate 76. The aft face 75 of forward plate 76 (FIG. 8) may include a side-to-side recess 89 extending along the entire width of the forward plate 76 to form a biasing lip 91 at the bottom-most portion of the forward plate 76. In some embodiments, the depth of recess 89 may be between about 20-50% of the thickness of the forward plate 76. In some embodiments, the recess 89 may be between about 0.01-0.02 inches (0.25-0.5 mm) deep. The biasing lip 91 may be a rounded projection that extends along the width of the forward plate 76, and projects in an aft direction from the bottom-most portion of the forward plate 76. The side-to-side recess 89 on the aft face 75 may be positioned below the pocket 71 on the forward face 45. Including the pocket 71 and the side-to-side recess 89 may decrease the wall thickness of the forward plate 76, and consequently the weight of damper 36 and the bending stiffness of the forward plate 76. The dimensions of pocket 71 and the side-to-side recess 89 may be such that the forward plate 76 may have a desired stiffness while maintaining the stresses in the forward plate 76 to within acceptable limits (for instance, below an elastic strength limit).

The forward face 88 of aft plate 78 faces the forward direction of rotor 30, and the aft face 87 faces the aft direction of rotor 30. The width and height of the aft plate 78 are larger than the width and height of the forward plate 76. Area-wise, aft plate 78 is larger than under-platform cavity 60 and includes a lower extension 124 and an upper extension 128 separated by a substantially rectangular shaped discourager 120. When assembled on the rotor 30, the aft plate 78 of the damper 36 may extend over, and cover, the opening at the aft end 63 of under-platform cavity 60. The aft plate 78 may include an aft seating surface 98 that extends in a forward direction from the forward face 88 of the upper extension 128. The sloping sides of the aft seating surface 98 may converge on a line that is inclined at an angle between about −10° to +10° from the aft plate 78. Similar to the forward seating surface 94 of the forward plate 76, the aft seating surface 98 may also have a wedge-like configuration and may be configured to mate with the underside geometry of platform 50 of turbine blade 32.

A nub 125 may protrude in the aft direction from a bottom portion of the aft face 87 of lower extension 124 (of aft plate 78). In some embodiments, the nub 125 may include a substantially rectangular projection from the aft face 87. In some embodiments, the nub 125 may be centrally positioned widthwise and may be located at a bottom-most end of the lower extension 124. In some embodiments, the discourager 120 may extend substantially perpendicularly from the aft face 87 in the aft direction, and form a ledge-like feature that extends along an entire width of the aft plate 78.

The longitudinal structure 80 of damper 36 may include a central wall 104 and at least one reinforcing structural element. For example, longitudinal structure 80 may include an outer structural element 106 and an inner structural element 108 to provide increased structural rigidity to damper 36. In an exemplary embodiment, longitudinal structure 80 may be substantially I-shaped in cross-section. An inverted U-shaped notch 86, that extends through the width of the central wall 104, is formed between the central wall 104 and the forward plate 76. During assembly of the damper 36 on the rotor 30, the notch 86 allows the forward plate 76 to flex and snap over the circumferential outer edge 42 of the rotor 30. The wall thickness of the central wall 104 at the root of the notch 86 may be such that the stress in this region will be below an acceptable limit, when the forward plate 76 flexes. When damper 36 is assembled on the rotor 30, the forward face 45 of the forward plate 76 (of damper 36) may form a flush surface with the front surface 62 (of shank 53) of the root structures 52 on either side of damper 36. As will be explained in more detail later, this flush surface increases cooling efficiency by reducing windage heating, cavity swirl, and rotor pumping.

Figure 11:
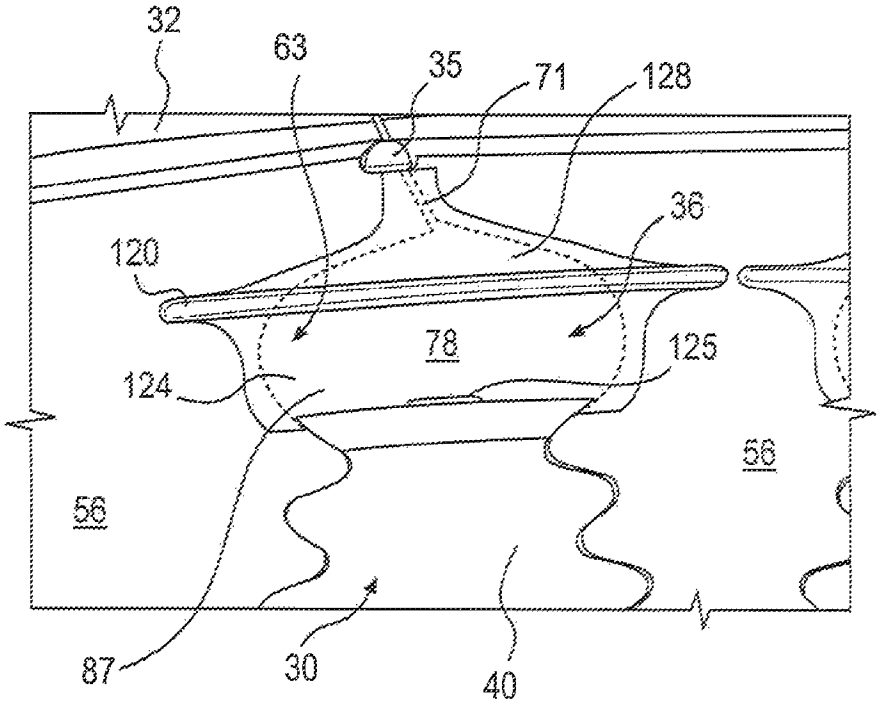
FIG. 11 is an illustration of a portion of an exemplary turbine rotor assembly as viewed from the aft end of the turbine rotor assembly.
Figure 10:
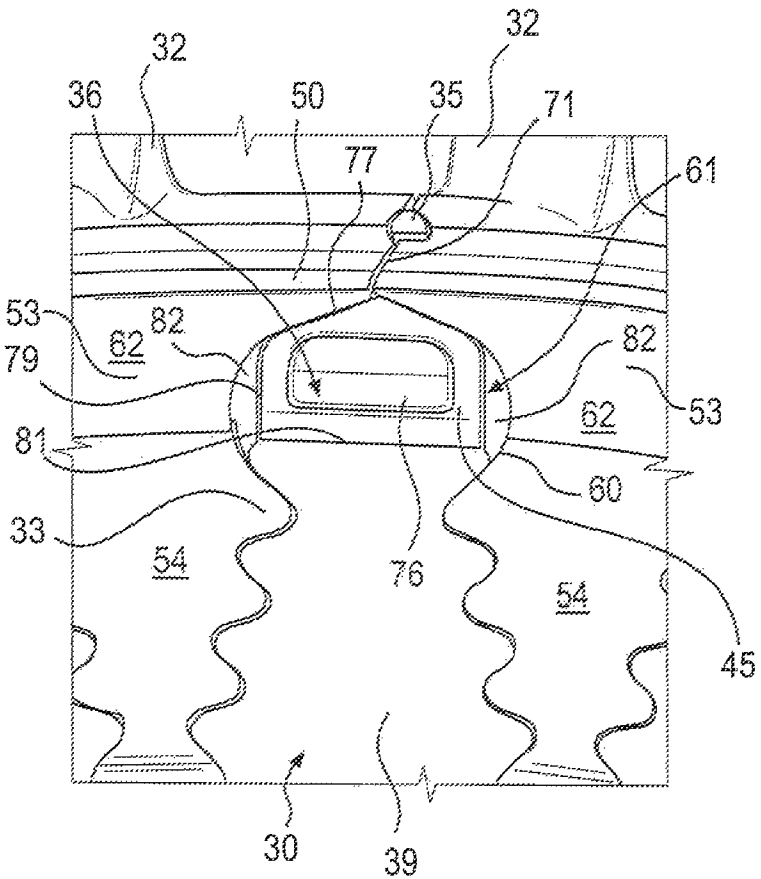
FIG. 10 is an illustration of a portion of an exemplary turbine rotor assembly as viewed from the forward end of the turbine rotor assembly.

FIGS. 10-13 illustrate a damper 36 installed on rotor 30, and positioned in the under-platform cavity 60 between two adjacent turbine blades 32. FIGS. 10 and 11 illustrate the damper 36 from the forward end and the aft end, respectively, of the rotor assembly 22. FIG. 12 illustrates a 3-D sectional view of the damper 36 on the rotor 30, and FIG. 13 illustrates a cross-sectional view of the turbine rotor assembly 22 through a damper 36. It should be noted that the seal plate 38 has been removed in FIG. 10 to show features behind the seal plate 38. In the discussion below, reference will be made to FIGS. 10-13. The thickness of rotor 30 may be such that the front surface 62 of each root structure 52 may be flush with the forward face 45 of (the forward plate 76 of) damper 36 upon installation. In this disclosure, two surfaces are considered to be "flush" if the distance (that is, the out-of-plane distance between forward face 45 and front surface 62) between the two surfaces is less than or equal to 0.015 inches (0.38 mm). As will be described later, arranging the front surface 62 to be flush with the forward face 45 increases cooling efficiency by reducing windage heating, cavity swirl, and rotor pumping. As previously described, the tapered upper walls 77 of forward plate 76 forms a wedge-shaped feature that follows the angle of the root structure 52 as it approaches the underside of platform 50. The shanks 53 of the turbine blades 32 rest against this wedge-shaped feature when the turbine blades 32 are assembled on the rotor 30.

As seen in FIG. 10, forward plate 76 of the damper 36 is sized such that it is slightly smaller than the forward end 61 of the under-platform cavity 60. Therefore, a gap 82 is formed between the forward plate 76 and the shanks 53 of adjacent turbine blades 32. In some embodiments, the area of gap 82 on each side of forward plate 76 may be between about 0.03-0.05 $in^2$ (19.35-32.26 $mm^2$), while in some embodiments, this area may be between about 0.038-0.045 $in^2$ (24.51-29.03 $mm^2$). These gaps 82 are sized to permit sufficient cooling air to enter the under-platform cavity 60 (to cool the blade shanks 53) while retaining sufficient strength. Since the forward face 45 of the forward plate 76 (of damper 36) is flush with the front surface 62 of shank 53, a substantially planar surface (or a flush surface) is presented to the cooling air 46 in the region directly upstream of the air gaps 82. A step between these surfaces (forward face 45 and front surface 62) will create a non-flush surface that will perturb the cooling air upstream of the air gaps 82 as the rotor 30 rotates. This perturbation of the cooling air may deteriorate the cooling of the rotor assembly 22 by causing detrimental effects such as cavity swirl and air pumping. Therefore, a flush arrangement of the blades 32 on the rotor 30 improves the cooling of the rotor assembly 22.

When damper 36 is installed on the rotor 30, the forward plate 76 flexes and fits over the circumferential outer edge 42 of the rotor 30 with the biasing lip 91 (at the bottom-most portion of the forward plate 76) pressing against the forward face 39 of the rotor 30. In this configuration, the flat side and bottom walls 79, 81 of the forward plate 76 terminate below the circumferential outer edge 42 of the rotor 30, but above the first lobe 33 of the fir-tree configuration of root structure 52 (see FIG. 10). As explained previously, the outer diameter of the seal plate 38 with the circumferential lip 31 extends to just below the bottom wall 81 of the forward plate 76 (see FIGS. 12 and 13) to cover the gaps formed at the interface of root structure 52 and slots 58 (of rotor 30). In the installed configuration of damper 36, a central region of the longitudinal structure 80 may be positioned above circumferential outer edge 42 of rotor 30 within under-platform cavity 60. In some embodiments, portions of the longitudinal structure 80 on either side of the central region (forward foot 114 and aft foot 116) may rest on the circumferential outer edge of rotor 42 (FIG. 9) during assembly.

Figure 14:
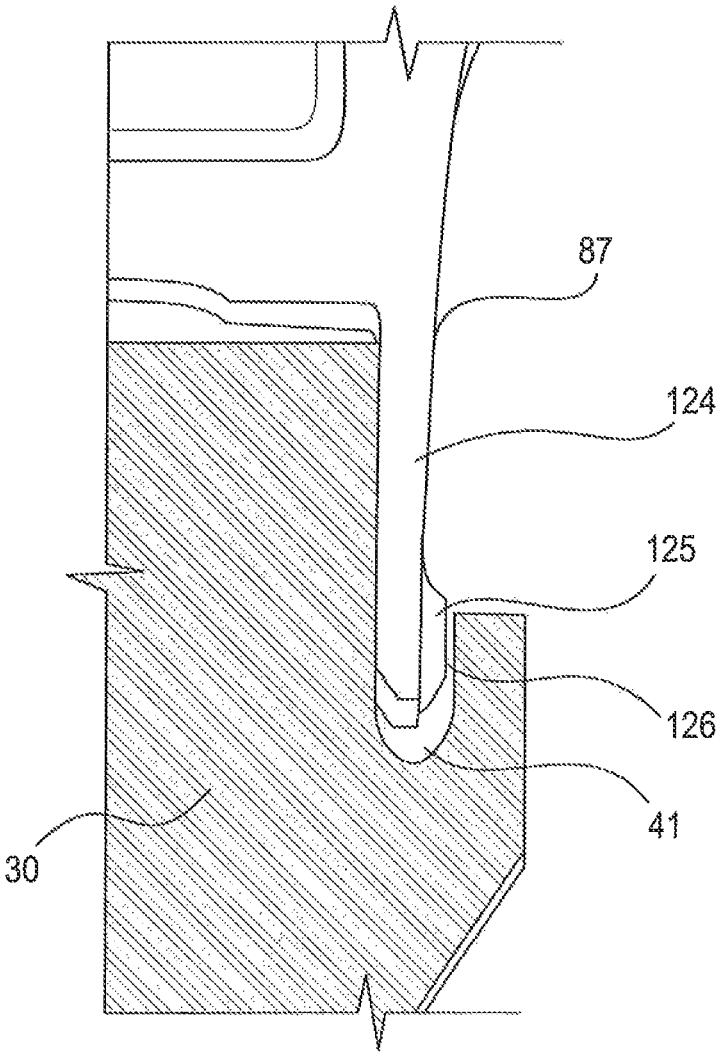
FIG. 14 is an enlarged view of a portion of an exemplary turbine rotor assembly.

With reference to FIG. 11, the dashed line illustrates the profile of the shanks 53 of adjacent turbine blades 32 that are covered by the aft plate 78 of the damper 36. The upper extension 128 of aft plate 78 includes a non symmetric profile (about a vertical axis) and may be configured to cover a similarly angled profile of adjacent blade shanks 53. The lower extension 124 of aft plate 78 extends beyond the outer profile of the blade shanks 53 of the adjacent turbine blades 32 and covers the aft end 63 of under-platform cavity 60. In this configuration, the bottom portion of the lower extension 124 fits into a hook or a U-shaped circumferential groove 41 provided on the aft face 40 of rotor 30 (FIGS. 12 and 14). To enable the bottom portion of the lower extension 124 to easily enter the groove 41 as the damper 36 is installed on the rotor 30, groove 41 may be provided on a projection that extends in the aft direction from the aft face 40 of the rotor 30 (see FIGS. 12-13). FIG. 14 illustrates an enlarged view of the bottom portion of the lower extension 124 positioned in groove 41. When the lower extension 124 is positioned in the groove 41, an aft face 126 of the nub 125 is positioned in close proximity to, or in contact with (due to part-to-part dimensional variations), a vertical wall of the U-shaped groove 41. In this configuration, the groove 41 prevents the lower extension 124 from deflecting or translating in an aft direction.

Since the aft plate 78 closes the opening of the under-platform cavity 60 at the aft end 63, cooling air that enters the under-platform cavity 60 through gaps 82 at the forward end 61 is blocked from exiting the under-platform cavity 60 at the aft end 63. This restriction in the flow of cooling air increases the air pressure in the under-platform cavity 60, and prevents (or reduces) the ingress of combustion air into the under-platform cavity 60. A seal pin 35 (FIGS. 10, 11) positioned between the platforms 50 of the two adjacent blades helps to seal a passage 74 between the blade platforms 50 and maintain the pressure in the under-platform cavity 60. Centrifugal forces on the damper 36 during rotation of the rotor assembly 22 may cause deflection of the aft plate 78. The interaction between the aft face 126 of nub 125 and the groove 41 prevents excessive deflection (or translation) of the aft plate 78, and assists in sealing of the under-platform cavity 60 at the aft end 63.

As previously explained, the discourager 120 protrudes in the aft direction from the aft plate 78 (see FIGS. 11-13). As can be seen more clearly in FIGS. 7 and 8, discourager 120 extends along the width from one side of aft plate 78 to the opposite side, and protrudes in the aft direction to form a fin-like protruding structure. When dampers 36 are positioned between each two adjacent turbine blades 32 of the turbine rotor assembly 22, the discouragers 120 of adjacent dampers 32 form circumferentially extending ledges or rings that protrude in the aft direction from the rotor 30. Similarly, the lip 31 of the seal plate 38, and the platforms 50 of adjacent turbine blades 32 form a circumferentially extending ledge or a ring that protrudes in the forward direction from the turbine rotor assembly 22. As will be explained in more detail below, these forward and rearward protruding structures assist in separating the combustion gases (that pass between the airfoils 48 of the turbine blades 32) from the cooling air stream that passes through the under-platform cavity 60.

INDUSTRIAL APPLICABILITY

The disclosed turbine blade and turbine rotor assembly may be applicable to any rotary power system, for example, a gas turbine engine. The process of assembling the turbine blade and the turbine rotor assembly in a gas turbine engine, and the process of regulating of the flow of combustion gases and cooling air past the turbine rotor assembly in the gas turbine engine will now be described.

During assembly of turbine rotor assembly 22, dampers 36 may be attached to turbine rotor 30, for example, by an interference fit. In order to position damper 36 on turbine rotor 30, biasing lip 91 of forward plate 76 may be temporarily flexed in a direction away from aft plate 78 to provide sufficient clearance for forward and aft plates 76, 78 (of damper 36) to fit over circumferential outer edge 42 of turbine rotor 30. When the damper 36 is positioned over the circumferential outer edge 42, the bottom portion of the lower extension 124 (of aft plate 78) fits into the circumferential groove 41 on the aft face 40 of rotor 30. Once damper 36 is properly positioned on turbine rotor 30 between two adjacent slots 58, the forward plate 76 is released to engage the biasing lip 91 with the forward face 39 of the rotor 30 and install the damper 36 on the rotor 30. In the installed configuration of damper 36, the bottom portion of the lower extension 124 presses against the aft face 40, and the biasing lip 91 of the forward plate 76 presses against the forward face 39 of the rotor 30. And, in some embodiments, the forward foot 114 and the aft foot 116 of the longitudinal structure 80 may rest against the circumferential outer edge 42 of the rotor 30 (FIGS. 7-9).

Turbine blades 32 may be slidably mounted in slots 58 of turbine rotor 30 on either side of the dampers 36, for example, in a forward-to-aft direction. In lieu of installing all of the dampers 36 prior to installing turbine blades 32, it is also contemplated that dampers 36 may be installed on turbine rotor 30 after or between the installation of the turbine blades 32. The process of installing turbine blades 32, and dampers 36 on turbine rotor 30 to form turbine rotor assembly 22 may be repeated until all slots 58 on turbine rotor 30 are occupied by a turbine blade 32. After the turbine blades 32 are installed, the seal plate 38 is assembled on the forward face 39 of the rotor 30 by positioning the inner diameter of the seal plate on the corresponding groove of the rotor 30, and installing the snap ring 37 (FIGS. 12, 13). The snap ring 37 retains the seal plate 38 on the rotor 30. In the installed configuration, the circumferential lip 31 at the outer diameter of the seal plate 38 presses against the forward faces 54 of the blade root structures 52 (and forward face 39 of rotor 30) to lock the blades in the rotor 30.

During operation of GTE 100, a portion of the compressed air from compressor section 10 is directed to the combustor section 15 to produce combustion gases 44 and another portion is used as air for other purposes, such as, for example, cooling air 46. As shown in FIGS. 5 and 6, these combustion gases 44 and cooling air 46 flow through the turbine section 20 in a forward-to-aft direction separated from one another by a wall (not shown). The configuration of the rotor 30, the damper 36, and the seal plate 38 may help regulate the flow of the hot combustion gases 44 and the cooling air 46 through the turbine rotor assembly 22. In turbine rotor assembly 22, the combustion gases 44 pass through the space between the airfoils 48 (that is, above blade platforms 50) and rotate the turbine blades 32, while the cooling air 46 generally flows through the space below the blade platforms 50 (see FIGS. 12, 13). The blade platform 50 and the portion of the circumferential lip 31 that extends in the forward direction assists in directing the cooling air 46 into the under-platform cavity 60. Meanwhile, the portion of the circumferential lip 31 that protrudes in the aft-direction presses against the forward face 39 of the rotor 30 and minimizes the amount of cooling air 46 flowing into the gaps between the blade root structure 52 and the slots 58 of the rotor 30.

The cooling air 46 enters the under-platform cavity 60 through air gaps 82 at forward end 61 of under-platform cavity 60 and cools the root structures 52 of the turbine blades 32. Since the front surface 62 of the blade shank 53 and the forward face 45 of the damper 36 are arranged to be flush on the forward side of rotor 30, a substantially planar surface (or a flush surface) is presented to the cooling air 46 in the region upstream of the air gaps 82. As previously explained, the flush surface improves cooling by reducing cavity swirl and air pumping.

It is known that an ingress of combustion gases 44 into the under-platform cavity 60 may cause premature failure of turbine blades 32 due to excessive heat and corrosion. To minimize ingress of combustion gases into the under-platform cavity 60, a positive pressure is maintained within the under-platform cavity 60 by restricting the flow of air out of the under-platform cavity 60 through the aft end 63 of the under-platform cavity 60. Cooling air 46 flow out of the under-platform cavity 60 is restricted by closing the aft end 63 of the under-platform cavity 60 using the aft plate 78 of the damper 36. To effectively maintain a positive pressure in the under-platform cavity 60 during operation of the GTE 100, the bottom portion of the aft plate 78 is provided with a nub 125 that engages with a circumferential groove 41 of the rotor 30. At the aft end of the turbine rotor assembly 22, the discouragers 120 of adjacent dampers 36 form an axially extending separating wall and impedes the flow of combustion gases 44 in a radially inward direction to mix with the cooling air 46.

While a specific geometry of a damper 36, a seal plate 38, and a turbine blade 32 are described herein, it is contemplated that several modifications may be made to the geometry of these components. For example, forward plate 76 of damper 36 may include one or more passages (not shown) for further regulating the flow of cooling air 46 within under-platform cavity 60. Further, damper 36 may include fewer or more extensions to accomplish additional sealing and or retention between turbine rotor assembly components.

It will be apparent to those skilled in the art that various modifications and variations can be made to the disclosed turbine blade and turbine rotor assembly without departing from the scope of the disclosure. Other embodiments of the turbine blade assembly will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A turbine rotor assembly for a gas turbine engine, comprising:

a turbine rotor having a plurality of turbine blade slots extending radially inward from an outer rim, each turbine blade slot extending radially from an inner end to the outer rim and extending axially from a forward end to an aft end of the rotor, and a groove positioned in the aft end of the rotor;

a plurality of turbine blades having an airfoil and a root structure extending from opposite sides of a platform, the root structure of each turbine blade including a portion shaped to be received in a corresponding turbine blade slot of the rotor; and a damper positioned between the root structures of two adjacent turbine blades of the plurality of turbine blades, the damper extending axially from the forward end to the aft end of the rotor and including a forward plate at the forward end and an aft plate at the aft end, wherein a front face of the forward plate forms a flush surface with front surfaces of the root structures of the two adjacent turbine blades, and wherein a nub extends in an aft direction from a lower portion of a lower extension of the aft plate and is positioned in the groove of the turbine rotor.

2. The turbine rotor assembly of claim 1, wherein the groove is positioned between two adjacent turbine blade slots.

3. The turbine rotor assembly of claim 1, wherein an aft face of the nub is positioned facing a surface of the rotor within the groove.

4. The turbine rotor assembly of claim 1, wherein the nub is width-wise centrally positioned on the lower extension.

5. The turbine rotor assembly of claim 1, wherein the platforms of the two adjacent turbine blades form an overhanging ledge above the flush surface.

6. The turbine rotor assembly of claim 5, further including a seal plate attached to the forward end of the rotor, the seal plate extending upwards from a first end below the blade slots to a second end located proximate the outer rim of the rotor.

7. The turbine rotor assembly of claim 6, wherein the second end of the seal plate includes a circumferential lip that extends from the seal plate to form an overhanging ledge below the flush surface.

8. The turbine rotor assembly of claim 1, wherein the aft plate of the damper extends outwards from the aft end of the rotor.

9. A turbine rotor assembly of a gas turbine engine, comprising:

a turbine rotor extending from a forward end to an aft end, the turbine rotor including a plurality of turbine blade slots extending radially inwards from an outer rim, and a groove positioned at the aft end;

a plurality of turbine blades having a root structure extending below a platform, a portion of the root structure of each turbine blade being positioned in a corresponding turbine blade slot of the rotor; and a damper positioned between the root structures of two adjacent turbine blades of the plurality of turbine blades, the damper including, a forward plate at the forward end of the rotor and an aft plate at the aft end of the rotor, and a nub that extends in an aft direction from a lower portion of the aft plate, wherein the nub is positioned in the groove of the turbine rotor.

10. The turbine rotor assembly of claim 9, wherein the nub is width-wise centrally positioned on the aft plate.

11. The turbine rotor assembly of claim 9, wherein a front face of the forward plate of the damper forms a flush surface with front surfaces of the root structures of the two adjacent turbine blades.

12. The turbine rotor assembly of claim 11, wherein the platforms of the two adjacent turbine blades form an overhanging ledge above the flush surface.

13. The turbine rotor assembly of claim 9, further including a seal plate attached to the forward end of the rotor, the seal plate extending upwards from a first end below the blade slots to a second end located proximate the outer rim of the rotor.

* * * * *